US007413270B2

(12) United States Patent
Chang et al.

(10) Patent No.: US 7,413,270 B2
(45) Date of Patent: Aug. 19, 2008

(54) LOCKING DEVICE OF SLIDING DRAWER

(76) Inventors: Guey-Yun Chang, 11, Alley 52, Lane 413, Ying Tao Rd. Ying Ghor Town, Taipei County (TW) 239; Kuo-Sheng Huang, 11, Alley 52, Lane 413, Ying Tao Rd. Ying Ghor Town, Taipei County (TW) 239

( * ) Notice: Subject to any disclaimer, the term of this patent is extended or adjusted under 35 U.S.C. 154(b) by 83 days.

(21) Appl. No.: 11/519,695

(22) Filed: Sep. 13, 2006

(65) Prior Publication Data

US 2008/0061664 A1 Mar. 13, 2008

(51) Int. Cl.
*A47B 88/04* (2006.01)

(52) U.S. Cl. ..... 312/333; 312/319.1; 312/334.46; 312/334.47

(58) Field of Classification Search ..... 312/330.1, 312/333, 319.1, 334.1, 334.7, 334.8, 334.44, 312/334.46, 334.47; 384/21, 22
See application file for complete search history.

(56) References Cited

U.S. PATENT DOCUMENTS 6,126,255 A * 10/2000 Yang ..... 312/334.46
7,156,477 B1 * 1/2007 Lu ..... 312/333

* cited by examiner

*Primary Examiner*—James O Hansen
(74) *Attorney, Agent, or Firm*—WPAT, P.C.; Anthony King

(57) ABSTRACT

An improved locking device of sliding drawer comprises a sliding rail and a locking device, when the sliding drawer is pushed back to a cabinet body, the locking device is initiated when a second sliding track moves along the sliding rail towards a direction of the cabinet body. When one of the circumferential parts of the locking device comes into contact with a protruding portion of a first sliding track, an attaching portion is rotated around the rotating shaft at a rotation center thereby biasing a flexible part of the locking device and generating a first restoring force, a flexible device of the first sliding track is triggered by the second sliding track to generate a second restoring force, when the protruding portion is inserted through the trench and seated within the arc-shaped structure, the first restoring force of the flexible device is released such that the drawer is now locked within the cabinet body.

5 Claims, 5 Drawing Sheets

LOCKING DEVICE OF SLIDING DRAWER

BACKGROUND OF THE INVENTION

1. Field of Invention

The present invention relates a locking device of sliding drawer particularly the present invention relates a locking device of a sliding drawer, capable of locking the drawer within a cabinet body automatically, when it is being pushed back to the cabinet body.

2. Description of the Related Art

Present-day, the main objective of the conventional designs of the sliding drawers in the market is to increase the convenient operation of the sliding drawer. Most of the conventional designs are used to install one end of two sliding paths onto the inner sides of a cabinet body. Another two sliding paths are provided at the external sides of the cabinet body so that the drawer can be pushed in and out. Ball shaped objects, such as bearings or rollers are designed within the sliding paths to increase the sliding movement of the drawer. Those conventional sliding drawer's designs constitute some problems. When the drawer is slid in and out from the cabinet body, the slight vibration resulted from the external force or the collision would cause the drawer falling out from the cabinet body easily without warning. The unpleasant mess caused by falling out of objects from the drawer and the damage to the drawer or the sliding paths is a big problem. Furthermore, this kind of design of sliding drawer can cause seriously body harm to the user when the sliding drawer falls out.

One of the conventional designs of the sliding drawer is to increase the height of the front part of the cabinet body or the front end of the sliding path slightly so that the front part of the drawer is higher than the back part of the drawer to prevent the drawer from sliding out completely from the cabinet body. This design still cannot secure the sliding drawer in the cabinet body during moving or earthquake activity, when the incline angle is increased, the sliding drawer can be slid out from the cabinet body easily resulting greater damage.

Another type of conventional designs is to utilize the locking device to secure the drawer within the cabinet body and ensure the privacy of the objects in the drawer. A locking key is normally required to unlock the drawer, and pull out the drawer from the cabinet body, the locking key is also required to secure the drawer in the cabinet body. Once the locking key is lost, it creates inconvenience to the user. Therefore, those conventional designs of the sliding drawers constitute some defaults and inconvenience to the users.

SUMMARY OF THE INVENTION

It is an object of the present invention to provide an improved design of a sliding drawer that can overcome the conventional design defaults.

It is another object of the present invention to provide an improved locking device structure that can be easily slid in/out of a cabinet body, and can secure the location of the sliding drawer within the cabinet body without causing any harm or danger.

The improved structure of the locking device of the sliding drawer of the present invention comprises a sliding trail, having a first sliding track installed in a cabinet body, and a second sliding track located in a drawer, wherein a protruding portion and a flexible device are provided in the first sliding track, the flexible device including a sliding body and a flexible unit. A locking device having a rotating shaft positioned in the second sliding track is provided within the locking device of sliding drawer, wherein an attaching portion is provided at one end of the locking device facing toward the protruding portion and a flexible part is provided at the opposite end of the locking device. A protruding part and a trench are provided at the attaching portion, circumferential parts are located at both sides of the protruding part of the attaching portion, two ends of the trench are integrated with the circumferential parts to form two openings, wherein a portion of the trench that is located between the openings faces toward the protruding portion and forms an arc-shaped structure.

As the drawer is pushed back towards the cabinet body, the locking device is initiated when the second sliding track moves along the sliding trail towards a direction of the cabinet body. When one of the circumferential parts provided at the attaching portion of the locking device comes into contact with the protruding portion of the first sliding track, the attaching portion is rotated around the rotating shaft at a rotation center thereby biasing the flexible part of the locking device and generating a first restoring force, the flexible device of the first sliding track is triggered by a movement of the second sliding track to generate a second restoring force, when the protruding portion is inserted through one of the openings of the trench and seated within the arc-shaped structure, the first restoring force of the flexible device is released the drawer is now locked within the cabinet body. When the drawer is pushed back towards the cabinet body, the second restoring force is increased such that the attaching portion is rotated around the rotating shaft at the rotation centre, the flexible part of the locking device stores the first restoring force, the protruding portion is removed from the other of the openings of the trench, the flexible device releases the second restoring force that pushes the drawer out of the cabinet.

Both the forgoing general description and the following detailed description are exemplary and explanatory only and are not restrictive of the invention, as claimed.

BRIEF DESCRIPTION OF THE DRAWINGS

The accompanying drawings are included to provide a further understanding of the present invention, and are incorporated in and constitute a part of this specification. The drawings illustrate embodiments of the present invention and, together with the description, serve to explain the principles of the invention. In the drawings.

DESCRIPTION OF THE PREFERRED EMBODIMENTS

Figure 1:
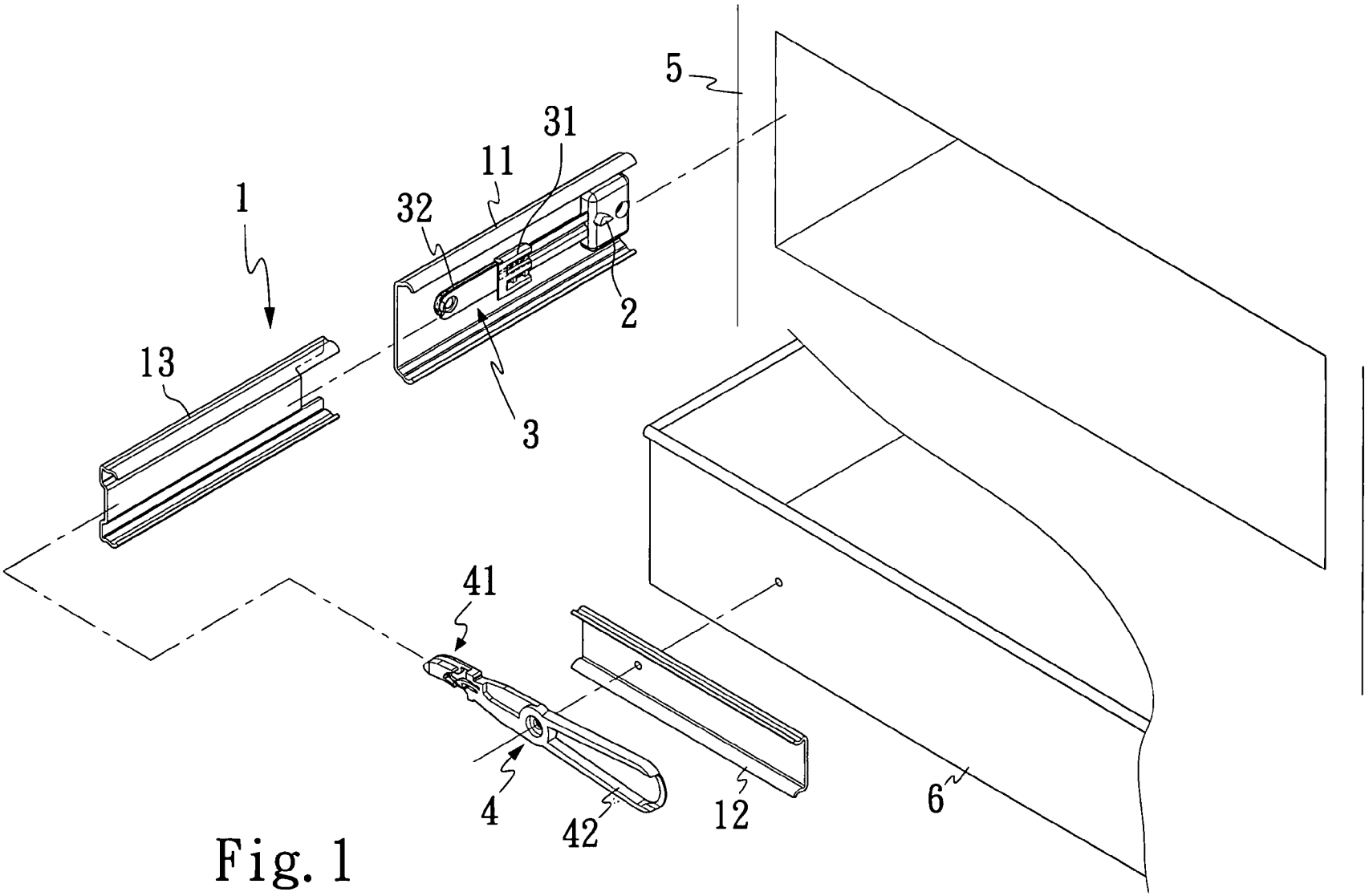
FIG. 1 is an assembly view of a locking device of sliding drawer in accordance with a preferred example of the present invention.
Figure 2:
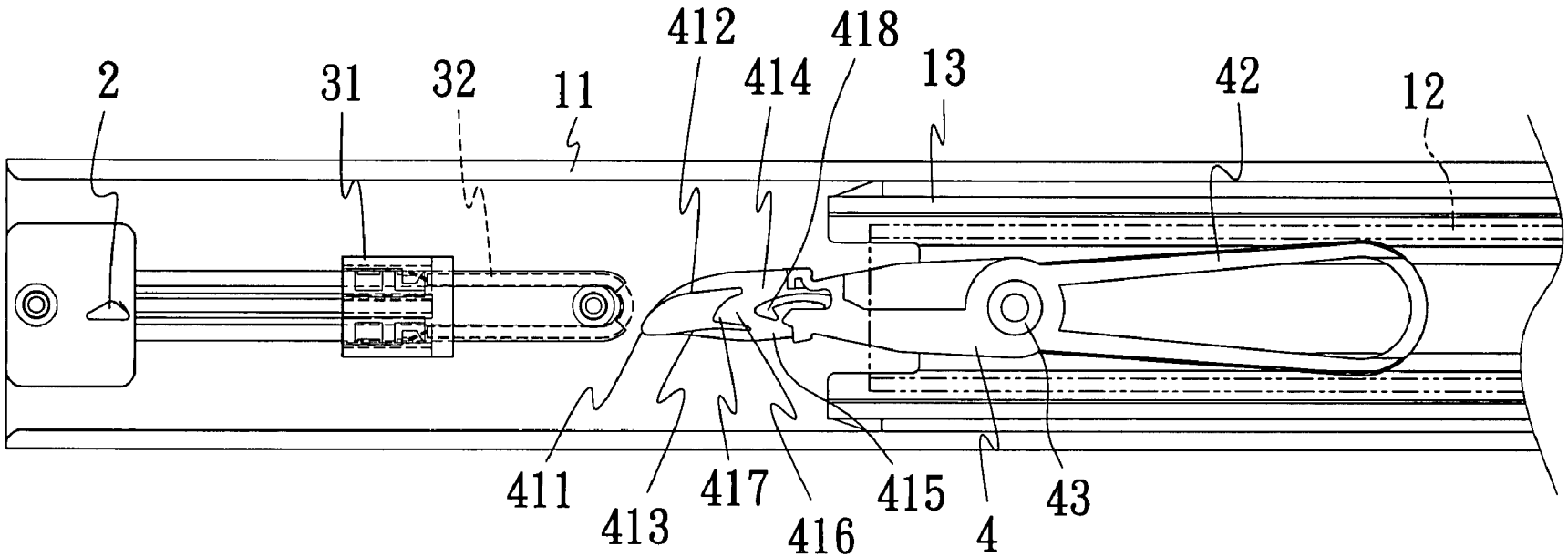
FIG. 2 is a partial cross-sectional view of the locking device of sliding drawer in accordance with the preferred example of the present invention.

FIGS. 1 and 2 illustrate views of a locking device of sliding drawer in accordance with a preferred example of the present invention. The locking device of sliding drawer comprises a sliding trail 1, a protruding portion 2, a flexible device 3 and a locking device 4. The sliding trail 1 further comprises three sliding tracks, wherein a first sliding track 11 is installed in a cabinet body 5. A second sliding track 12 is provided as an external track outside a drawer 6, whereas a middle sliding track 13 is located in between the first sliding track 11 and the second sliding track 12. The protruding portion 2 is formed into a triangular prism shaped structure, and a flexible device area provided within the first sliding track 11. The flexible device 3 includes a sliding body 31 and a flexible unit 32, wherein the sliding body 31 and the flexible unit 32 are both installed in the first sliding track 11. The sliding body 31 is assembled in the first sliding track 11 and can be moved along the sliding rail 1. The position of the sliding body is at one end of the flexible unit 32, and another end of the flexible unit 32 is the first sliding track 11.

When the second sliding track 12 is moved, the flexible device 3 of the first sliding track 11 will be triggered to initiate the movement of the sliding body 31 in order to generate the second restoring force from stretching the flexible unit 32. A rotating shaft 43 of the locking device 4 is located at the second sliding track 12, wherein the locking device 4 faces toward one end of the triangular prism 2 that comprises an attaching portion 41, and a flexible part 42 is provided at another end of the triangular prism 2. A protruding part 411 and a trench 416 are provided at the attaching portion 41, wherein the protruding part 411 faces toward the triangular prism 2, and the protruding part 411 is utilized to separate the attaching portion 41 into two circumferential parts, 412 and 413. The trench 416 is shaped by an arc-shaped structure 417 and a flexible shaft 418. Two parts of the trench 416 are integrated with the two circumferential parts 412 and 413 form two openings, 414 and 415, wherein the part of the trench 416 is located between the openings 414 and 415 that faces toward the triangular prism comprises the arc-shaped structure 417. Another part of the trench 416 comprising the flexible shaft 418 is located closer to the rotating shaft 43, wherein the flexible shaft 418 can alter its position and its shape is in accordance with the various width lengths of the trench 416.

The flexible part 42 is located inside the second sliding track 12. The flexible part 42 comprises a hollowed out structure to induce the force coefficient of the flexible part 42 lower than the force coefficient of the attaching portion 41. When the rotating shaft 43 is acted at the center of the rotation for the attaching portion 41, the attaching portion 41 can retain its fixed shape, and the deformation of the flexible part 42 can be stored as the first restoring force.

Figure 3:
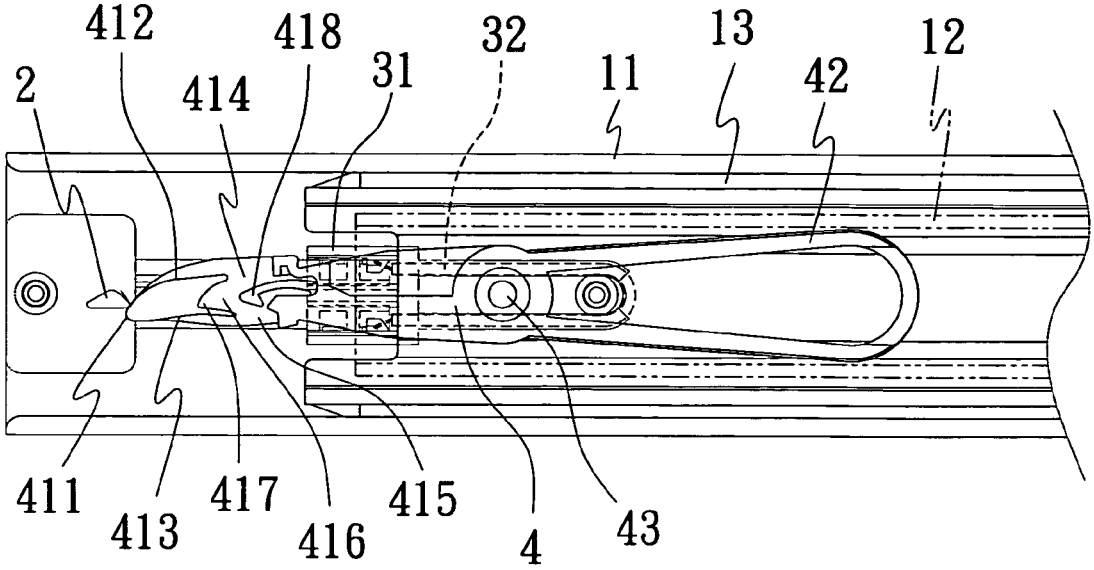
FIG. 3 is a cross-sectional view of a protruding part and circumferential parts of a locking device of sliding drawer in accordance with a preferred example of the present invention.

FIG. 3 is a cross-sectional view of a protruding part and circumferential parts of a locking device of sliding storage box in accordance with a preferred example of the present invention. When a drawer (not shown) is pushed back to the cabinet body 5, the locking device 4 will be initiated by the second sliding track 12 to move along the sliding trail 1 towards the direction of the cabinet body 5. The circumferential part 412 will be into contact with the triangular prism 2, and the middle sliding track 13 will be initiated by the second sliding track 12 to move the sliding body 31 of the flexible device 3 in such that the flexible unit 32 will be stretched to generate a first restoring force.

Figure 4:
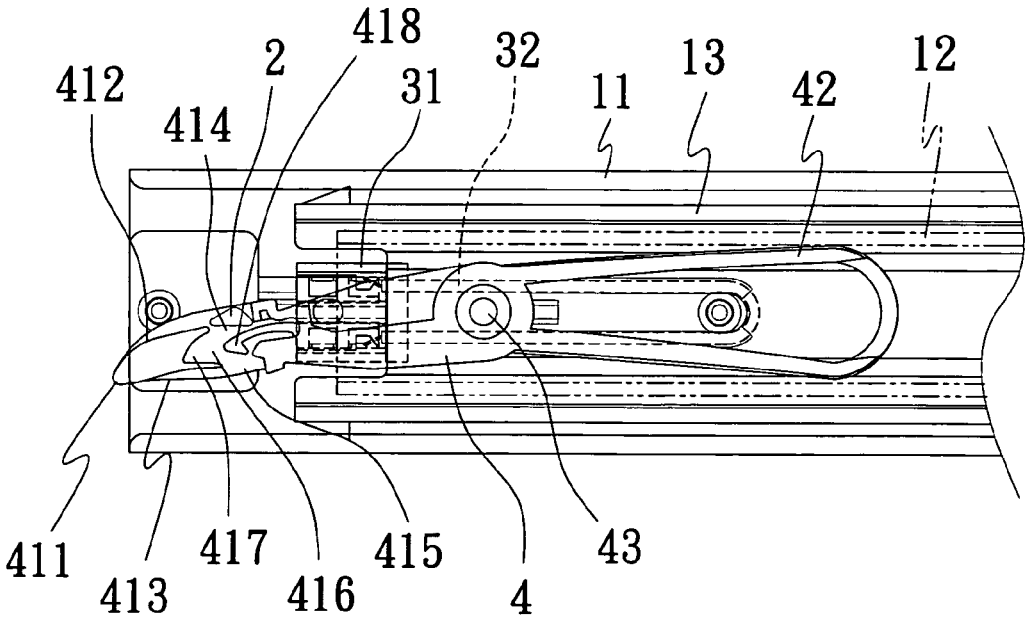
FIG. 4 shows a cross-sectional view of the protruding part of the locking device sliding towards the opening's 414 position in accordance with a preferred example of the present invention.

FIG. 4 illustrates a cross-sectional view of the protruding part of the locking device sliding to the opening's 414 position in accordance with a preferred example of the present invention. When the drawer (not shown) is pushed back to the end of the cabinet body, the triangular prism 2 is moved to one of the openings 414 to increase a first restoring force. Simultaneously, when the angular displacement of the attaching portion 41 is increased to cause the flexible part 42 to deform in such that the second restoring force is generated.

Figure 5:
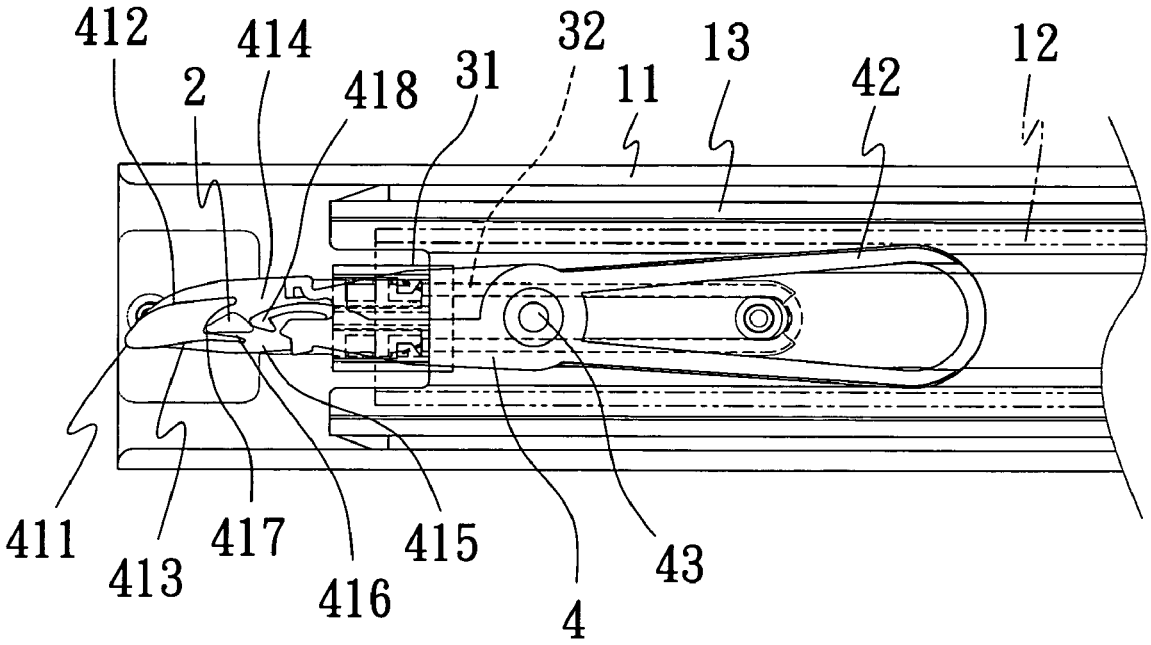
FIG. 5 is a partial cross-sectional view of the protruding part of the locking device sliding to a position of the bending portion in accordance with a preferred example of the present invention.

FIG. 5 is a partial cross-sectional view of the protruding part of the locking device sliding to a position of the bending portion in accordance with a preferred example of the present invention. The flexible part 42 generates a first restoring force to allow the attaching portion 41 returning to its original angular displacement so that the triangular prism 2 can slide into the trench 416. The flexible unit 32 is released part of the restoring force energy to move the middle sliding track 13, the second sliding path 12 and the locking device 4 outward. The triangular prism 2 moves along the trench 416 to seat within the arc-shaped portion 417 that one of angles of the cross-sectional area of the triangle is facing towards the opening 415 of the trench 416. The drawer is thus locked within the cabinet body (not shown).

Figure 6:
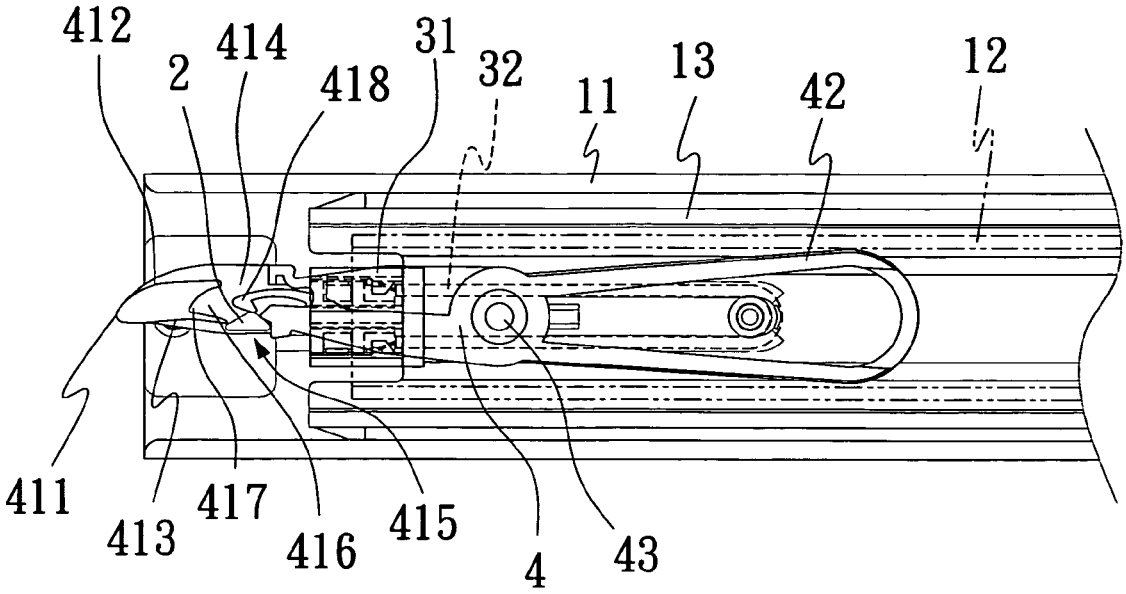
FIG. 6 is a partial cross-sectional view of the protruding part sliding towards the opening's 415 position in accordance with another preferred example of the present invention.

FIG. 6 is a partial cross-sectional view of the protruding part sliding to the opening's 415 position in accordance with another preferred example of the present invention. When the drawer is pulled out from the cabinet body (not shown), the drawer will be pushed-in firstly, the second sliding track 12 will initiate the middle sliding track 13 to move the sliding body 31 in order to stretch the flexible unit 32 so that the first restoring force can be increased. The attaching portion 41 is rotated around the rotating shaft 43 acting at a central point of the rotation in such that the flexible part 42 of the locking device 4 can store generate a second restoring force. The triangular prism 2 is moved along the trench 416 to the opening 415.

Figure 7:
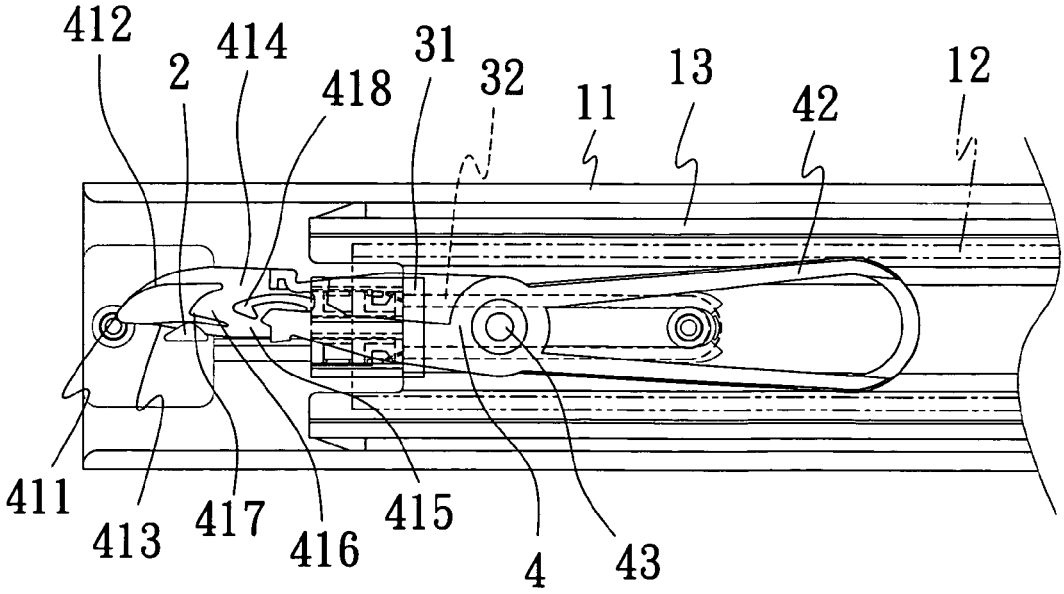
FIG. 7 illustrates a partial cross-sectional view of the protruding part contacted with the circumferential part 413.

FIG. 7 illustrates a partial cross-sectional view of the protruding part contacted with the circumferential part 413. The flexible unit 32 generates the first restoring force to cause the sliding body 31 moving the middle sliding path 13 and the second sliding track 12. The triangular prism 2 will then move along the circumferential part 413 to push the drawer away from the cabinet body.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A locking device of a sliding drawer, comprising:

a sliding rail, having a first sliding track installed in a cabinet body and a second sliding track located on a drawer, wherein a protruding portion and a flexible device are provided in the first sliding track, the flexible device including a sliding body and a flexible unit; and a locking device having a rotating shaft positioned in the second sliding track, wherein an attaching portion is provided at one end of the locking device facing toward the protruding portion and a flexible part is provided at the opposite end of the locking device, a protruding part and a trench are provided at the attaching portion, circumferential parts are located at both sides of the protruding part of the attaching portion, two ends of the trench are integrated with the circumferential parts to form two openings, wherein a portion of the trench that is located between the openings faces toward the protruding portion and forms an arc-shaped structure; as the drawer is pushed back towards the cabinet body, the locking device is initiated when the second sliding track moves along the sliding trail towards a direction of the cabinet body, when one of the circumferential parts provided at the attaching portion of the locking device comes into contact with the protruding portion of the first sliding track, the attaching portion is rotated around the rotating shaft at a rotation center thereby biasing the flexible part of the locking device and generating a first restoring force, the flexible device of the first sliding track is triggered by a movement of the second sliding track to generate a second restoring force, when the protruding portion is inserted through one of the openings of the trench and seated within the arc-shaped structure, the first restoring force of the flexible device is released such that the drawer is now locked within the cabinet body; when the drawer is pushed back towards the cabinet body, the second restoring force is increased such that the attaching portion is rotated around the rotating shaft at the rotation center, the flexible part of the locking device stores the first restoring force, the protruding portion is removed from the other of the openings of the trench, the flexible device releases the second restoring force that pushes the drawer out of the cabinet body.

2. The locking device of the sliding drawer of claim 1, wherein the protruding portion is formed with a triangular prism shape.

3. The locking device of the sliding drawer of claim 1, wherein the sliding body is installed and moved along the first sliding track, the sliding body is located at one end of the flexible unit, and another end of the flexible unit comprises the first sliding track, when the flexible device of the first sliding track is initiated by the second sliding track to generate the second restoring force, a movement of the sliding body results in the flexible unit storing the second restoring force.

4. The locking device of the sliding drawer of the claim 1, wherein a flexible shaft is provided at one side of the arc-shaped structure that is closer to the rotating shaft to adjust widths of the trench.

5. The locking device of the sliding drawer of claim 1, wherein the flexible part of the locking device comprises a hollowed out structure to induce a force coefficient of the flexible part lower than a force coefficient of the attaching portion such that the attaching portion is rotated around the rotating shaft at the center of the rotation, wherein the attaching portion can retain its fixed shape and deformation of the flexible part can be stored as the first restoring force.

* * * * *